US006170474B1

(12) United States Patent
Israel

(10) Patent No.: US 6,170,474 B1
(45) Date of Patent: Jan. 9, 2001

(54) METHOD AND SYSTEM FOR CONTROLLED EXHAUST GAS RECIRCULATION IN AN INTERNAL COMBUSTION ENGINE WITH APPLICATION TO RETARDING AND POWERING FUNCTION

(75) Inventor: Mark Israel, Amherst, MA (US)

(73) Assignee: Diesel Engine Retarders, Inc., Christiana, DE (US)

( * ) Notice: Under 35 U.S.C. 154(b), the term of this patent shall be extended for 0 days.

(21) Appl. No.: 09/165,364

(22) Filed: Oct. 2, 1998

Related U.S. Application Data

(60) Provisional application No. 60/060,785, filed on Oct. 3, 1997.

(51) Int. Cl.[7] ..... F02M 25/07

(52) U.S. Cl. ..... 123/568.14; 123/322; 123/568.21

(58) Field of Search ..... 123/568.14, 321, 123/322, 568.21

(56) References Cited

U.S. PATENT DOCUMENTS 4,075,990 * 2/1978 Ribeton ..... 123/568.14
4,426,986 * 1/1984 Muller et al. ..... 123/568.14
4,700,684 * 10/1987 Pischinger et al. ..... 123/322
4,875,455 * 10/1989 Hashimoto et al. ..... 123/568.14
5,406,918 * 4/1995 Joko et al. ..... 123/568.14
5,666,931 * 9/1997 Pierik et al. ..... 123/568.21
5,927,238 * 7/1999 Watson ..... 123/568.14
5,960,755 * 10/1999 Diggs et al. ..... 123/568.14
5,967,115 * 10/1999 Konopka ..... 123/568.14

* cited by examiner

*Primary Examiner*—Willis R. Wolfe
(74) *Attorney, Agent, or Firm*—David R. Yohannan; Collier Shannon Scott, PLLC

(57) ABSTRACT

In an internal combustion engine braking system which may provide compression release braking and/or exhaust braking, methods and systems are disclosed of controlling the overlap between an exhaust gas recirculation event and an intake valve event to optimize engine braking at various engine operating speeds. Optimization may be achieved by selectively advancing and retarding the opening and closing of an exhaust valve for exhaust gas recirculation. The opening and closing of the exhaust valve may be carried out responsive to the monitored levels of such engine parameters as: exhaust manifold pressure, exhaust manifold temperature, cylinder pressure, and/or cylinder temperature. Various engine parameters may be monitored. Control of exhaust gas recirculation may be responsive thereto, such that a monitored parameter does not exceed a predetermined level.

23 Claims, 7 Drawing Sheets

METHOD AND SYSTEM FOR CONTROLLED EXHAUST GAS RECIRCULATION IN AN INTERNAL COMBUSTION ENGINE WITH APPLICATION TO RETARDING AND POWERING FUNCTION

This application claims benefit for Provisional application Ser. No. 60/060,785 filed Oct. 3, 1997.

FIELD OF THE INVENTION the present invention relates generally to the field of exhaust gas flow control for internal combustion engines (ICE). More specifically, it relates to a method for controlling exhaust gas recirculation to control engine pressures, temperatures and NOx emissions.

BACKGROUND OF THE INVENTION

Flow control of exhaust gas through an ICE has been used in order to provide vehicle engine braking. Engine brakes may include exhaust brakes, compression release type brakes, and/or any combination of the two. The general principle underlying such brakes is the utilization of gas compression generated by the reciprocating pistons of an engine to retard the motion of the pistons and thereby help to brake the vehicle to which the engine is connected.

Exhaust brakes are known to be useful to help brake a vehicle, particularly heavy vehicles such as trucks and buses. Exhaust brakes may generate increased exhaust gas back pressure in an exhaust system, including an exhaust manifold, by placing a restriction in the exhaust system downstream of the exhaust manifold. Such restriction may take the form of a turbocharger, an open and closeable butterfly valve, or any other means of partially or fully blocking the exhaust system.

By increasing the pressure of the exhaust manifold, an exhaust brake also increases the residual cylinder pressure in the engine cylinders at the end of the exhaust stroke. Increased pressure in the cylinders, in turn, increases the resistance encountered by the pistons on their subsequent up-strokes. Increased resistance for the pistons results in braking the vehicle drive train which may be connected to the pistons through a crank shaft.

Exhaust brakes have been provided such that the restriction in the exhaust system is either fully in place or fully out of place due to the associated expense and complexity of a system with a variable restriction. These exhaust brakes produce levels of braking which are proportional to the speed of the engine at the time of exhaust braking. The faster the engine speed, the greater the pressure and temperature of the gas in the exhaust manifold and cylinders. The higher pressure and temperature result in increased resistance to the up-stroke of the piston in the cylinder and therefore, increased braking.

Since the exhaust system and engine cannot withstand unlimited temperature and pressure levels, the exhaust brake restrictions have had to be designed such that the operation thereof at a rated maximum engine speed will not produce unacceptably high pressures and temperatures in the exhaust system and/or engine. The restrictions have been designed such that they produce less than maximum temperatures and pressures, and less than maximum braking at engine speeds below the rated maximum speed. Accordingly, there is a need for a system and method for realizing increased exhaust braking at less than maximum engine speed using an exhaust restriction having a fixed size designed to produce maximum exhaust braking at the rated maximum engine speed.

Compression release brakes, or retarders, may be used in conjunction with, or independently of, exhaust brakes. Compression release retarders convert, at least temporarily, the cylinder of an internal combustion engine (of the compression ignition type for example) into an air compressor. A retarder converts an engine's kinetic energy into thermal energy by opposing the motion of the engine's pistons with compression developed in the cylinders. A compression release event may be initiated by a piston traveling through its up-stroke and compressing gas in the cylinder which opposes the upward motion of the piston. When the piston nears the top of its up-stroke, an exhaust valve can be opened to "release" the compression, thereby preventing the piston from recapturing the energy stored in the compressive heat generating up-stroke on the rebound of a subsequent expansive kinetic energy generating down-stroke. In this manner the kinetic energy of the piston is converted to thermal energy and conveyed from the engine through the exhaust system, resulting in a reduction of the engine's kinetic energy and an associated braking of the engine.

By repeating the compression release event in the engine's cylinders with each cycle of the engine, the engine develops retarding horsepower which helps brake the vehicle. This can provide a vehicle operator with increased control over a vehicle and substantially reduce wear on the service brakes of the vehicle. A properly designed and adjusted compression release retarder can develop a retarding horsepower that is a substantial portion of the operating horsepower developed by the engine on positive power.

An example of a prior art compression release engine retarder is provided by the disclosure of the Cummins, U.S. Pat. No. 3,220,392 (November 1965), which is incorporated herein by reference. Engine retarders, such as the Cummins retarder, employ after-market hydraulic systems to control the operation of exhaust valves to carry out the compression release event. These hydraulic systems may be driven and powered by the engine's existing valve actuation system, e.g., the rotating cams of an engine with a camshaft. When the engine is producing positive power, the hydraulic system is disengaged from the valve control system so that no release events occur. When compression release retarding is desired, the hydraulic system engages the exhaust valves to provide the compression release events.

Gobert, U.S. Pat. No. 5,146,890 (Sep. 15, 1992) for Method and a Device for Engine Braking a Four Stroke Internal Combustion Engine, assigned to Volvo AB, and incorporated herein by reference, discloses a system for increasing the braking power of a compression release retarder by opening an exhaust valve before a compression release event to allow additional exhaust gas to flow into the cylinder, i.e., an exhaust gas recirculation system. In the Gobert system, the exhaust valve is limited to being opened a predetermined fixed amount to recirculate exhaust gas into the cylinder. Gober employs a fixed lash system. The Gobert system, therefore, is the same as the prior art exhaust brakes, in that the opening, closing and lift of the exhaust valve for recirculation must be fixed such that the temperatures and pressures attained when the engine is operating at a maximum speed do not exceed the thermal and pressure load limits of the engine. It follows that the temperatures and pressures (and therefore braking) will be less than would be potentially possible at a less than maximum engine speed.

The prior art also discloses systems for varying the amount of lash between a slave piston and an exhaust valve to be opened by the slave piston. For example, Applicant is aware of the following prior art lash systems which may be used to vary lash and to thereby advance the time of valve opening: Meistrick, U.S. Pat. No. 4,706,625 (Nov. 17, 1987) for Engine Retarder With Reset Auto-Lash Mechanism; Hu, U.S. Pat. No. 5,161,501 (Nov. 10, 1992) for Self-Clipping Slave Piston; Custer, U.S. Pat. No. 5,186,141 (Feb. 16, 1993) for Engine Brake Timing Control Mechanism; and Hu, U.S. Pat. No. 5,201,290 (Apr. 13, 1993) for Compression Release Engine Retarder Clip Valve, all of which are incorporated herein by reference. While valve lash adjustment systems for advancing the time of valve opening exist, such systems are limited to (I) making the valve open earlier, close later and increasing lift, or (ii) making the valve open later, close earlier and decreasing lift. The lash systems do not enable independent control of the time a valve is opened and closed, which may be necessary to obtain optimal exhaust gas recirculation for temperature and pressure control in the engine compatible with optimal braking at various engine speeds.

None of the prior art methods and systems teach or suggest that the opening and closing of an exhaust valve may be controlled independent of each other to optimize exhaust gas recirculation for engine braking at various speeds. Furthermore, control of exhaust gas recirculation by selective variable levels of back pressure (i.e., Exhaust Pressure Regulation (EPR)) is also not taught. If the amount of exhaust gas recirculation were controlled (which it is not in Gobert) through independent control of exhaust valve opening and closing, the levels of pressure and temperature in the exhaust manifold and engine cylinders may be maintained such that optimal degrees of engine braking are attained at any engine speed. Since vehicles typically are required to undergo braking at any and all engine speeds, there is a need for a system and method of controlling the amount of exhaust gas recirculated to an engine cylinder.

The prior art methods or systems also do not teach or suggest that the opening and closing of an exhaust valve for exhaust gas recirculation may be controlled in response to the levels of various engine parameters, such as temperature, pressure and engine speed, so that the levels of such parameters may be regulated. There is accordingly a need to control exhaust gas recirculation in accordance with one or more engine parameters, such as temperature, pressure, and engine speed, etc., so that levels of engine braking which "push the limit" of such parameters may be attained for any engine speed. By monitoring such parameters and controlling the exhaust gas recirculation in response to the monitored levels of such parameters, the maximum allowable pressures and temperatures (and therefore maximum braking) may be reached for any engine speed.

Other exhaust gas recirculation systems and methods have not recognized the impact of varying the overlap between the time an exhaust valve is opened for recirculation and the time an intake valve is opened for intake. The exhaust valve may be opened for exhaust gas recirculation during the time the intake valve is opened on a downward intake stroke of a piston. The intake valve thereby provides an outlet during braking for high pressure gas flowing back from the exhaust manifold and into the cylinder. By varying the overlap of the opening of the intake and exhaust valves, the pressure and temperature of the exhaust manifold and cylinder may be controlled as well as the NOx emission of the engine.

Variation of the overlap of the intake and exhaust valve openings may also be controlled to regulate the level of noise produced by engine braking. Decreasing the overlap decreases the flow of gas and duration of the flow back through the intake valve and may accordingly decrease the level of noise emitted from the intake system of the engine.

It is apparent from the disclosures of the prior art that there remains a significant need for a method of controlling the opening and closing of an exhaust valve for exhaust gas recirculation in order to increase the effectiveness of and optimize compression release retarding and exhaust braking. Further, there also remains a significant need for a system that is able to perform that function over a wide range of engine operating parameters and conditions. In particular, these remains a need to "tune" compression release and exhaust brake systems to optimize their performance at operating speeds lower than the maximum rated speed of the engine in which they are used.

OBJECTS OF THE INVENTION

It is therefore an object of the present invention to provide a method and system of controlling exhaust gas recirculation to control conditions in an internal combustion engine.

It is another object of the present invention to provide a method and system of independently controlling the time an exhaust valve is opened and the time the valve is closed for exhaust gas recirculation.

It is a further object of the present invention to provide a method and system of controlling the temperature within an internal combustion engine by controlling exhaust gas recirculation.

It is still another object of the present invention to provide a method and system of controlling the pressure within an internal combustion engine by controlling exhaust gas recirculation.

It is yet another object of the present invention to provide a method and system of controlling the noise emitted from an internal combustion engine during engine braking by controlling exhaust gas recirculation.

It is yet still a further object of the present invention to provide a method and system of optimizing engine braking at multiple engine speeds.

It is still yet another object of the present invention to provide a method and system of Exhaust Pressure Regulation as a means for contributing to the control of exhaust gas recirculation.

Additional objects, within the scope of the invention and including all the variations attributable thereto, will be apparent to one of ordinary skill in the art as a result of a perusal of the present disclosure and the practice of the disclosed invention.

SUMMARY OF THE INVENTION

In response to this challenge, Applicant has developed an innovative and economical method of controlling an exhaust gas parameter in an internal combustion engine using an exhaust gas recirculation event and an intake valve event, comprising the steps of (a) generating exhaust gas back pressure in the engine; (b) monitoring an exhaust gas parameter level; and (c) carrying out an exhaust gas recirculation event responsive to the level of the parameter, wherein the exhaust gas parameter is controlled by selectively varying an overlap period between the exhaust gas recirculation event and the intake valve event alone or in combination with selectively varying exhaust back pressure.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
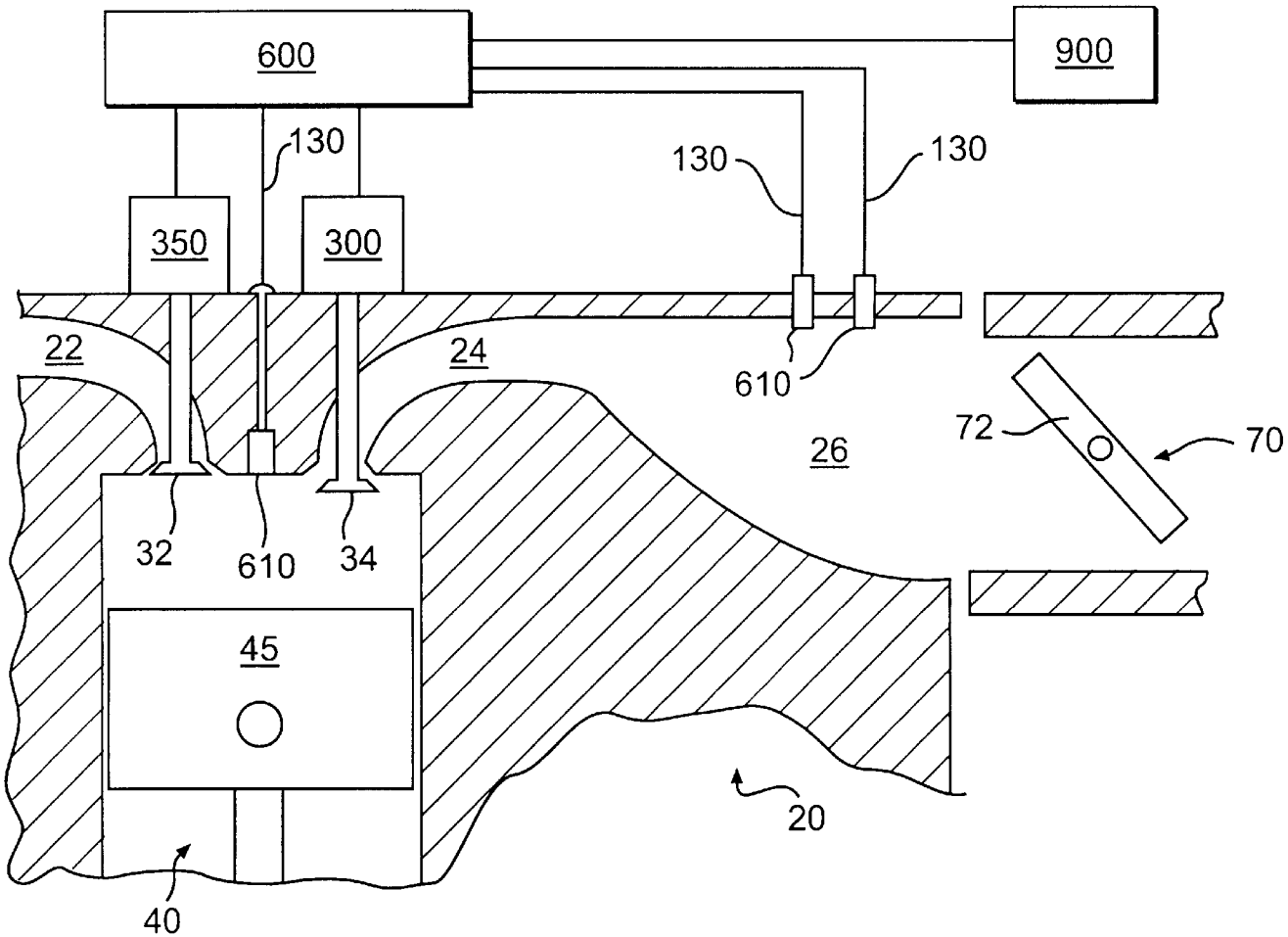
FIG. 1 is a schematic, sectional view of an engine cylinder, exhaust system and exhaust gas recirculation control system.

In an embodiment of the invention, an engine 20 shown in FIG. 1, may have a cylinder 40 in which a piston 45 may reciprocate upward and downward repeatedly, during the time the engine is used for braking. At the top of the cylinder 40 there may be at least one intake valve 32 and one exhaust valve 34. The intake valve 32 and exhaust valve 34 may be opened and closed to provide communication with an intake gas passage 22 and an exhaust gas passage 24, respectively. The exhaust gas passage 24 may communicate with an exhaust manifold 26, which may also have inputs from other exhaust gas passages (not shown). Downstream of the exhaust manifold 26 there may be a exhaust restriction means 70 which may be selectively activated to restrict the flow of exhaust gas from the manifold 26. Exhaust restriction means 70 may be provided by various means, such as a turbocharger turbine, or a butterfly valve 72 in the exhaust pipe, shown.

In the engine brake system and methods of the invention, the engine 20 may include an actuating subsystem 300, for opening the exhaust valve for exhaust gas recirculation. The engine may also include an intake valve actuating subsystem 350. There are several known subsystems for opening intake and exhaust valves for intake and exhaust events, and it is contemplated that the invention could use any of such subsystems and/or new systems developed by the Applicant or others.

The actuation of the exhaust valve 34 can be controlled as required by the subsystem 300 to open the valve for exhaust gas recirculation. Subsystem 300 may comprise various hydraulic, hydro-mechanical, and electromagnetic actuation means, including but not limited to means which derive the force to open the valve from a common rail or lost motion system. Many of these types of systems are known in the art and are suitable for use with the present invention. In addition, the actuating subsystem 300 used to perform the present invention may be electronically controlled.

Actuating subsystems 300 and 350 may be controlled by a controller 600, such that the level of pressure and/or temperature in the exhaust manifold 26 and/or cylinder 40 does not exceed a predetermined limit dictated by the materials making up the cylinder 40, the valves 32 and 34, and the manifold 26. The controller 600 may include a computer and may be connected to probes or ports 610 through any connection means 130, such as electrical wiring or gas passageways, to the cylinder 40, the exhaust manifold 26 or any other part of the exhaust system. The controller 600 may also be connected to an appropriate engine component 900, such as a tachometer, capable of providing the controller with a measurement of engine speed and/or other engine parameters.

The probes or ports 610 may be used to provide the controller 600 with an indication of the temperature and/or pressure in the cylinder 40, the manifold 26, and/or any other part of the exhaust system. The engine component 900 may be used to provide the controller 600 with a determination of the speed of the engine 20.

During engine braking, the exhaust restriction means 70 may be closed or partially closed to increase exhaust back pressure. Increased back pressure may be used to increase the charge of gas in the cylinder for braking by carrying out an exhaust gas recirculation event.

During exhaust gas recirculation, gas flow may reverse from the exhaust manifold 26 into the engine cylinder 40 and even back past the intake valve 32 and into the intake passage 22. Control of this backward gas flow through the exhaust and intake valves determines the system exhaust pressure profile and the resulting mass charge that is delivered to the cylinder on intake. The mass charge may affect compression release retarding braking because the greater the pressure and temperature of the gas in the cylinder, the greater the amount of braking realized from the reciprocating piston 45 as it is opposed by the high temperature and pressure gas.

With continued reference to FIG. 1, the controller 600 may vary the opening times, closing times, and magnitude of lift of the exhaust valve 34 during exhaust gas recirculation in accordance with the temperature, pressure and/or engine speed determinations which it may receive from the probes 610 and/or the engine component 900. Exhaust gas recirculation control is maintained such that the exhaust gas pressure in the exhaust manifold does not exceed engine operating limits for exhaust pressure and temperature. These limits may vary from engine to engine depending on the configuration of the engine and the engine manufacturers' tolerances. The preferred control strategy is to sense exhaust gas pressure and/or exhaust gas temperature, or both, and adjust the exhaust gas recirculation parameters, namely, opening and closing times of the exhaust valve and the magnitude of valve opening, to keep the exhaust pressure and temperature within the engine's limits.

Figure 2:
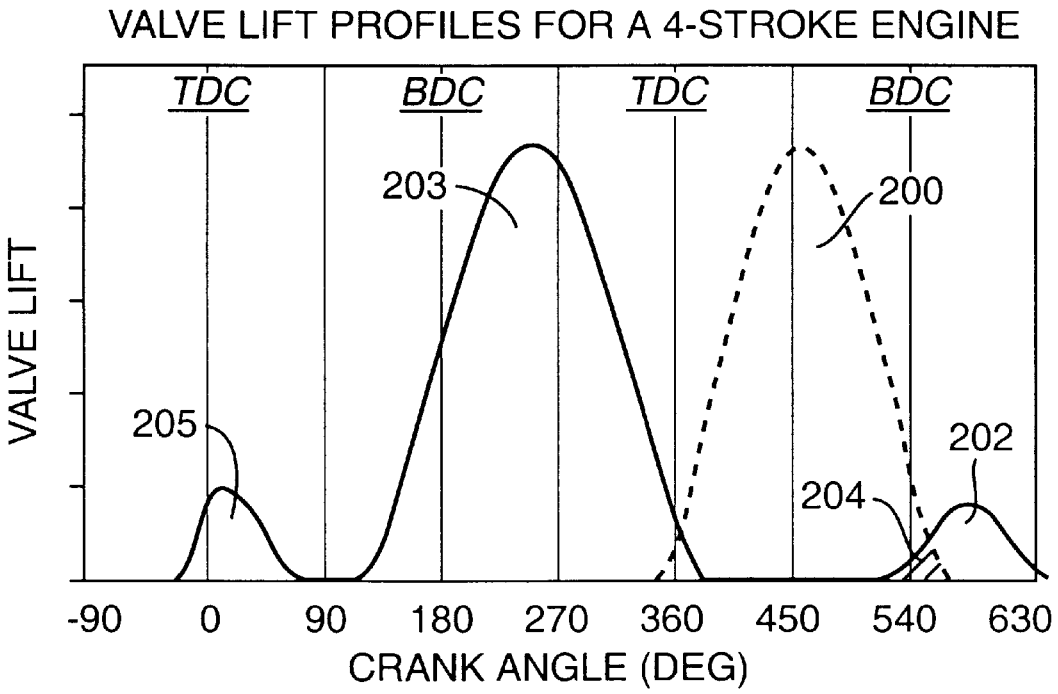
FIG. 2 is a graph of valve lift verses crank angle, illustrating overlap between the opening of an intake valve and an exhaust valve.

With reference to FIGS. 1 and 2, the opening of the intake valve 32 may be illustrated by area 200 (of FIG. 2), and the opening of the exhaust valve 34 for recirculation may be illustrated by area 202. Area 203 illustrates the opening of the exhaust valve 34 for exhausting combustion gases from the cylinder 40 and area 205 illustrates the opening of the exhaust valve 34 for a compression release event.

Since the engine 20 cannot withstand unlimited temperature and pressure levels generated by exhaust braking and compression release braking, exhaust gas recirculation is carried out such that the levels of temperature and pressure in the exhaust manifold 26, cylinder 40, or other component, do not exceed engine limits as monitored by the controller 600. By controlling the timing and the magnitude of the opening and closing of the exhaust valve 34 during exhaust gas recirculation, the amount of exhaust braking and compression release braking can be maximized for any engine speed. More specifically, controlling the timing of valve movement and magnitude of lift in response to measured pressure and temperature levels, can insure that the maximum amount of engine braking is realized at every engine speed.

By adjusting the amount of overlap (illustrated by shaded area 204 of FIG. 2) of the opening of the intake valve 32 (area 200) and the exhaust gas recirculation opening of the exhaust valve 34 (area 202), a controlled portion of the cylinder charge may continue back through the cylinder 40 into the intake passage 22. This back-flow past the intake valve 32 allows the desired exhaust back pressure to be maintained in the exhaust manifold 26, and thereby provides a means of controlling the pressure and temperature of the exhaust manifold.

With renewed reference to FIG. 1, by retarding (delaying closer to top dead center) the closing of the exhaust valve 34 for recirculation, a controlled portion of the cylinder gas mass may be forced back out past the exhaust valve 34 and into the manifold 26 by the upward movement of the piston 45 during the compression stroke. In particular, it may be advantageous in some instances to have the exhaust gas recirculation event last until after the piston has completed half of its compression stroke. In any event it may also be advantageous to have the exhaust gas recirculation event last until at least a substantial portion of the compression stroke is completed. Non-limited examples of EGR lasting for a substantial portion of the compression stroke are provided by FIGS. 7 and 11. After the closing of the exhaust valve 34 at the end of the exhaust gas recirculation event, the remaining mass may be compressed during the compression stroke and released into the exhaust manifold 26 during a following compression release event or exhaust stroke.

The greater the overlap of the opening of the intake and exhaust valves, the less pressure that may develop in the cylinder 40 due to back-flow of gas through the intake valve 32 from the higher pressure exhaust manifold 26, and therefore the less gas mass that may be left in the cylinder 40 for compression release braking. Should the crank angle at which the exhaust valve 34 is opened be advanced, then the overlap may be increased. Increased overlap may reduce exhaust back pressure (i.e. exhaust manifold pressure) and/or reduce the mass of gas captured in the cylinder 40 after all valves are closed. Conversely, retardation of the opening crank angle may reduce overlap and may therefore increase exhaust manifold pressure and/or the mass of gas captured in the cylinder. Advancement and retardation of the crank angle may therefore be used to control the exhaust manifold pressure (and related temperature) available for exhaust braking and/or the cylinder gas mass available for compression release braking.

Small adjustments to the advancement and retardation of the crank angle at which the exhaust valve 34 is closed is not believed to have an appreciable affect on exhaust back pressure and therefore little affect on the level of exhaust braking realized. The mass of gas captured in the cylinder is, however, affected by the crank angle for exhaust valve closure and therefore the crank angle of exhaust valve closure does have an affect on the level of compression release braking realized.

Accordingly, to increase the level of compression release braking at various engine speeds (provided the engine components can withstand the accompanying increased pressure and temperature), the mass of captured gas may be increased by advancement of the closure crank angle. To decrease the level of compression release braking, the mass of captured gas may be decreased by retardation of the closure crank angle of exhaust valve closure. Thus, by varying the exhaust gas recirculation event, variable compression release braking may be achieved with a fixed time compression release braking event.

The magnitude of the exhaust valve opening 202 (i.e., exhaust valve lift) for exhaust gas recirculation may also be controlled to optimize exhaust braking and/or compression release braking for various engine speeds. Reduction of lift may result in a reduction of the mass of captured gas in the cylinder and may also have an affect on the exhaust back pressure.

Figure 3:
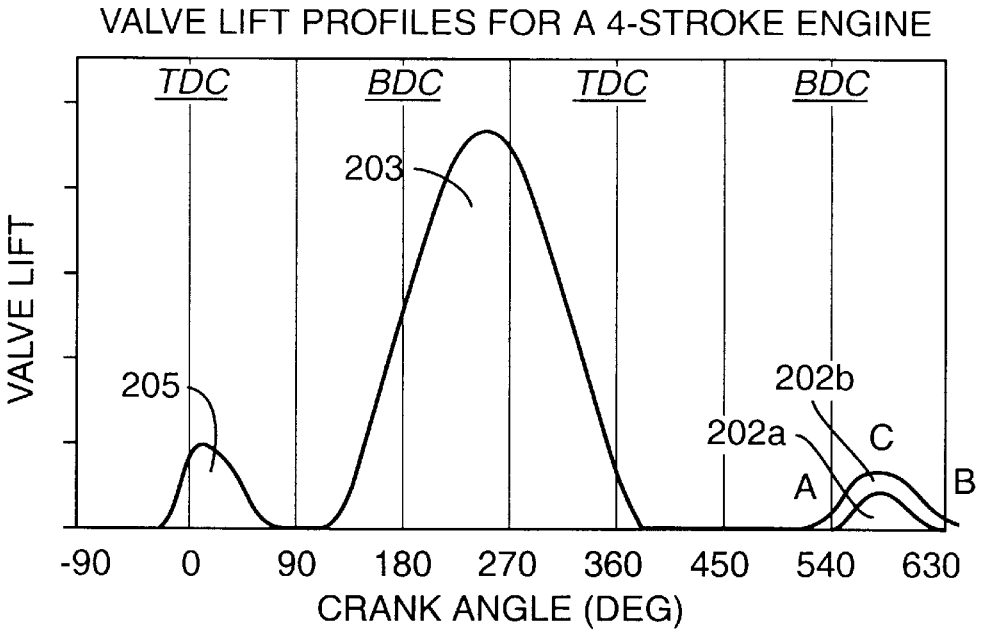
FIG. 3 is a graph of valve lift verses crank angle, illustrating the variability of the exhaust valve opening and closing times and lift during exhaust gas recirculation.

With reference to FIG. 3, where like numerals refer to like events shown in FIG. 2, variation of the opening times A, the closing times B, and the lift magnitudes C are shown as between two exhaust gas recirculation events 202*a* and 202*b*. The invention is not limited, however, to situations in which the advancement of an opening time A must be accompanied by the retardation of a closing time B and an increased lift C. It is appreciated that the opening and closing times, and the lift may be adjusted independently of each other.

Figure 4:
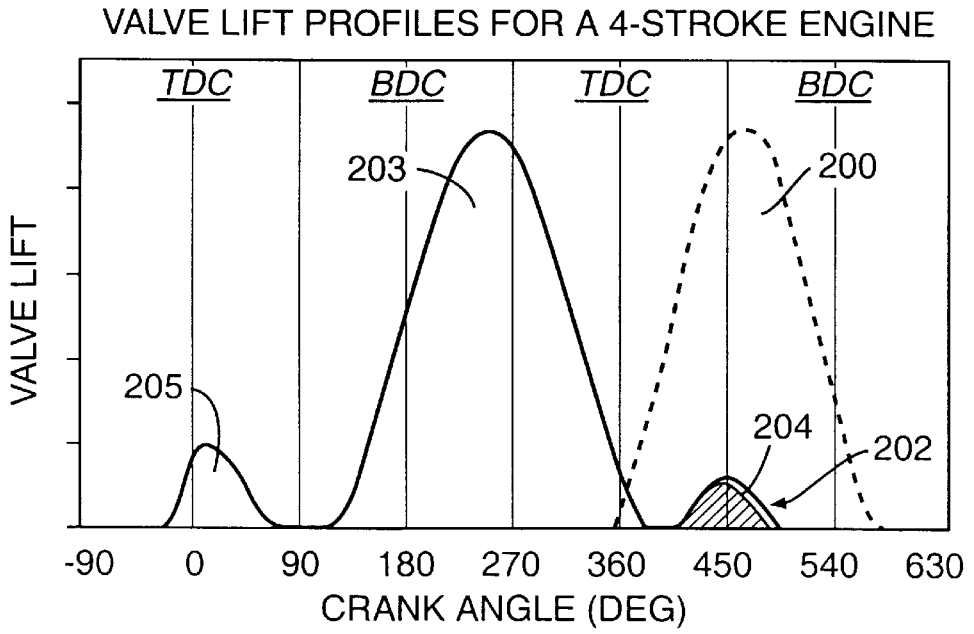
FIG. 4 is a graph of valve lift verses crank angle illustrating the occurrence of an exhaust gas recirculation event within an intake event.

With reference to FIG. 4, in which like numerals refer to like events of FIGS. 2 and 3, it may be seen that in some instances the exhaust gas recirculation event 202 may be advanced such that it occurs entirely within the intake event 200 to provide the desired amount of recirculation to the cylinder of the engine. In this mode, NOx production during positive power can be regulated as it provides the appropriate dilution of the cylinder charge.

Controlled exhaust gas recirculation may be used as a means for Exhaust Pressure Regulation by selectively varying the opening and closing points and the magnitude of opening of the EGR event.

Application to Exhaust Brake—Exhaust Pressure Regulation (EPR) is useful in an exhaust brake system to maintain an upper limit of back pressure in the engine while allowing high exhaust pressures to be developed at lower engine speeds. EPR effectively turns a fixed exhaust brake into a variable exhaust brake. In addition, the added mass in the cylinder can add a significant compression release portion to the braking effort.

Figure 5:
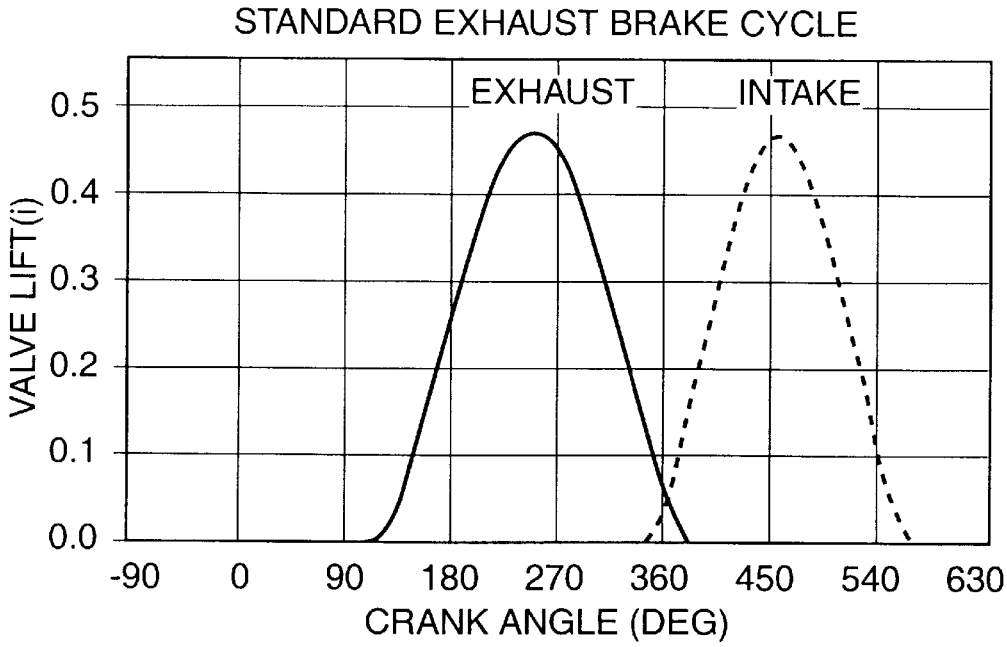
FIG. 5 is a graph of exhaust and intake valve lift for a standard exhaust brake cycle.
Figure 6:
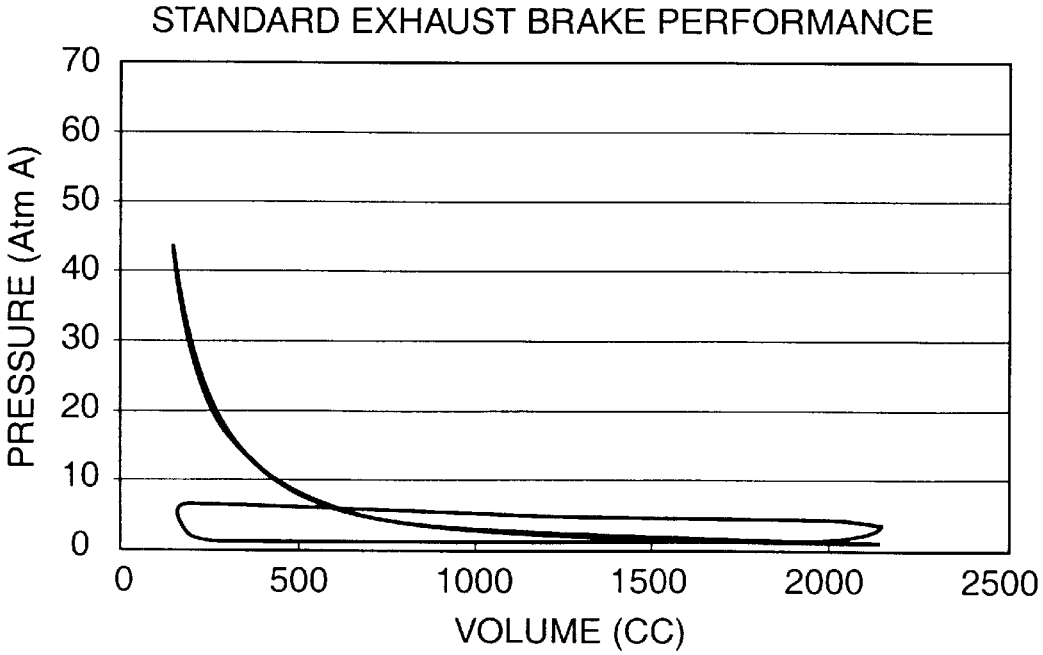
FIG. 6 is a pressure-volume graph for the standard exhaust brake cycle shown in FIG. 5.

FIG. 5 shows the intake and exhaust valve lift events for a standard exhaust brake cycle without EPR. With reference to FIG. 6, the exhaust back pressure on the system has increased the amount of pumping work in the gas exchange portion of the cycle, as indicated by the enlarged area on the lower part of the Pressure-Volume diagram. In this system, the exhaust valve springs are pre-loaded enough so that there is no reverse flow from the exhaust manifold to the cylinder. In the absence of sufficient pre-load, reverse flow may occur when exhaust pressure pulses exceed the spring force to temporarily open the exhaust valves. This uncontrolled opening of the exhaust valves, or natural "valve float," does provide pressure relief when it occurs, and establishes an upper limit to exhaust back pressure. Generally, valve float only occurs at higher engine speeds and is considered undesirable because valve seating velocity can be very high.

Figure 7:
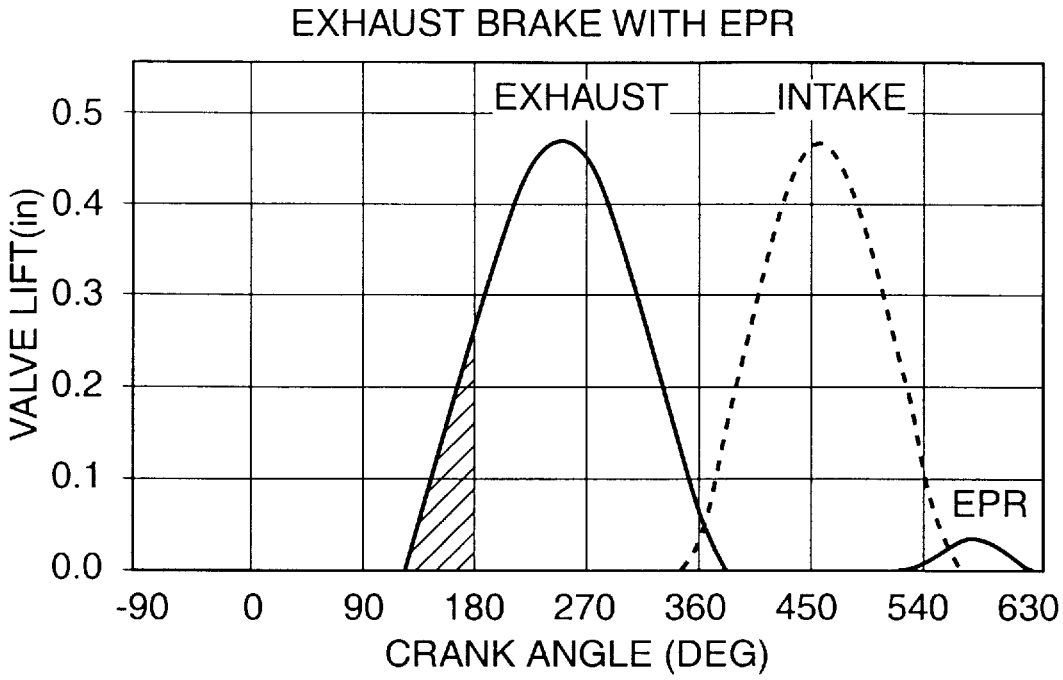
FIG. 7 is a graph of exhaust and intake valve lift for a standard exhaust brake cycle and exhaust pressure regulation event.
Figure 8:
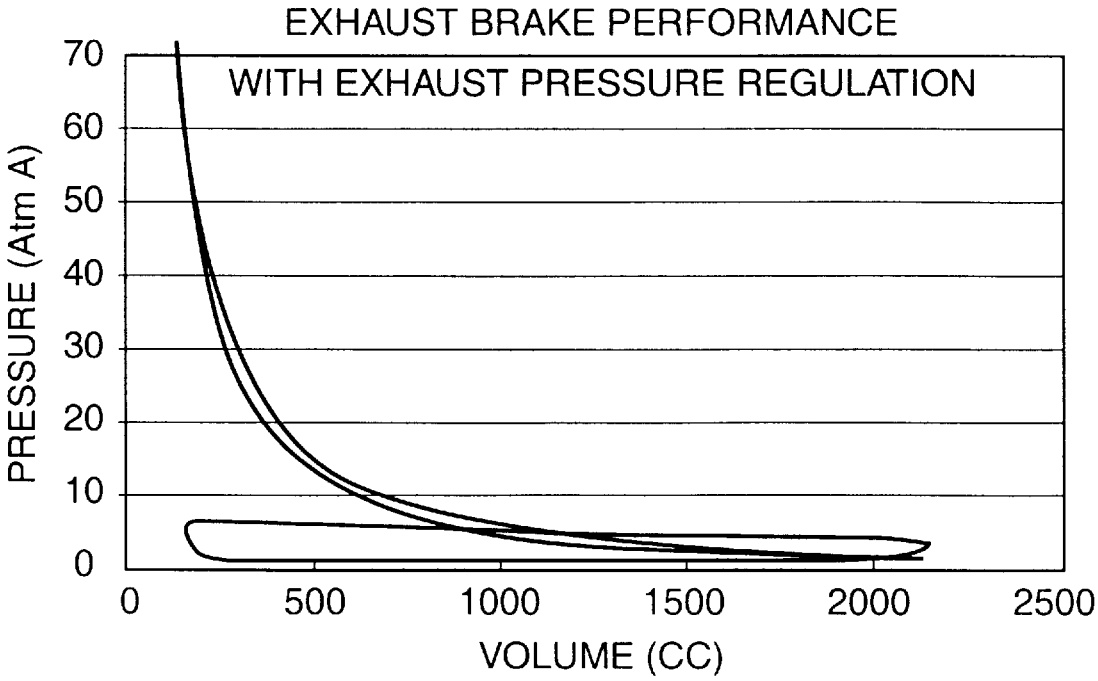
FIG. 8 is a graph of exhaust brake performance for the standard exhaust brake cycle with EPR shown in FIG. 7.

The system in FIG. 7 incorporates a controlled exhaust opening for Exhaust Pressure Regulation. A smaller than normal exhaust restriction is used and exhaust pressure is controlled by EPR. The EPR opening, closing and duration are dynamically adjusted at each engine speed to insure the maximum allowable back pressure is not exceeded at high engine speeds, while maintaining higher back pressure at lower speeds (as shown in FIG. 8). Exhaust brake performance benefits in two ways. The significant increase in cylinder pressure due to the added mass charged to the cylinder during reverse flow, is released during a subsequent compression blowdown at the normal exhaust valve opening, shaded in FIG. 7. This compression blowdown significantly increases the retarding power. Also, increased retarding power is achieved at low engine speeds by the ability to maintain higher exhaust pressure.

Application to Compression Release Brake—Compression release brakes generally depend on turbocharger boost pressure to charge the engine cylinders. Charging the cylinders by reverse flow with Exhaust Pressure Regulation is very effective for compression release engine braking. The compression release in combination with the exhaust brake greatly enhances the total braking effort, particularly at low and mid-range engine speeds where turbocharger response in sluggish.

Figure 9:
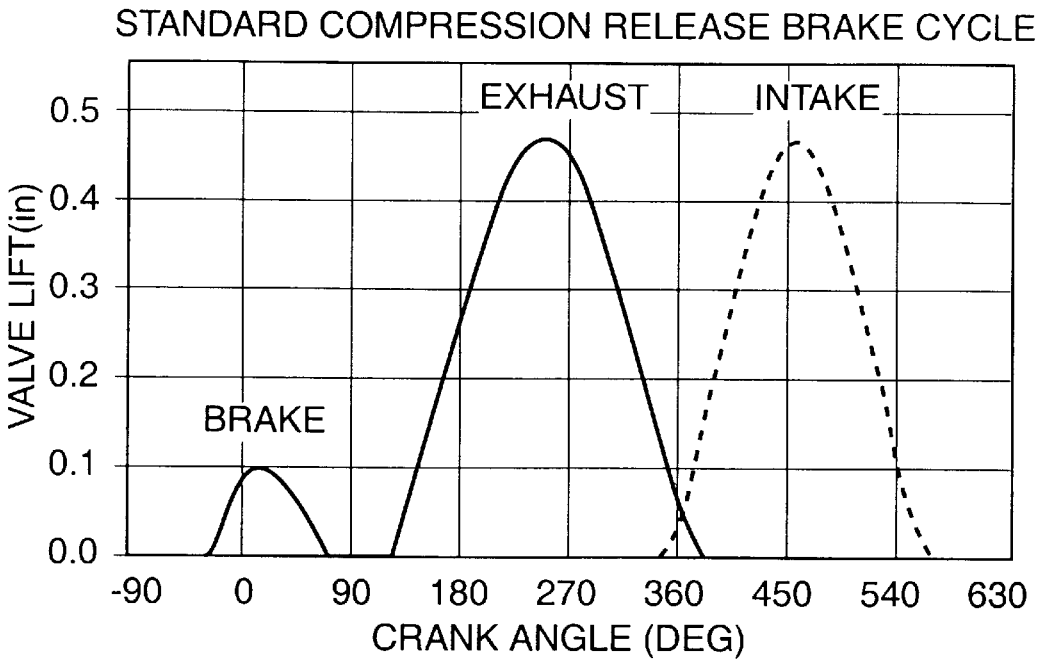
FIG. 9 is a graph of the exhaust and intake valve lift for a standard compression release brake cycle.
Figure 10:
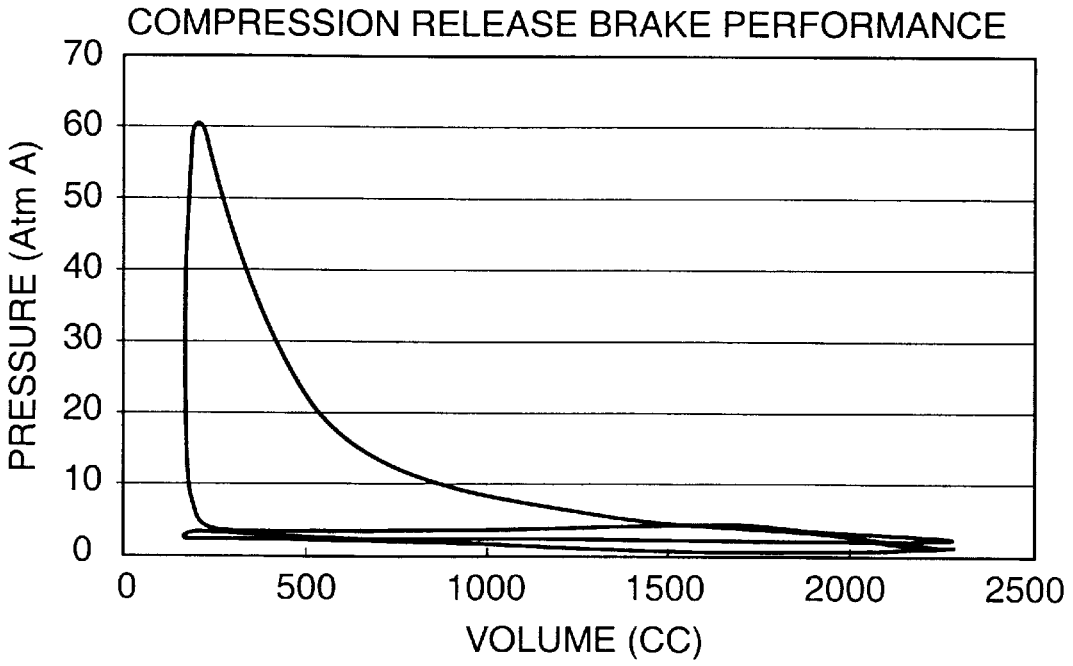
FIG. 10 is a graph of exhaust brake performance for the standard compression release brake cycle shown in FIG. 9.

FIG. 9 is the standard compression release engine brake cycle. The initial cylinder pressure (shown in FIG. 10) for compression is provided by the turbocharger. The turbocharger boost pressure degrades rapidly with decreasing engine speed and retarding power falls accordingly.

Figure 11:
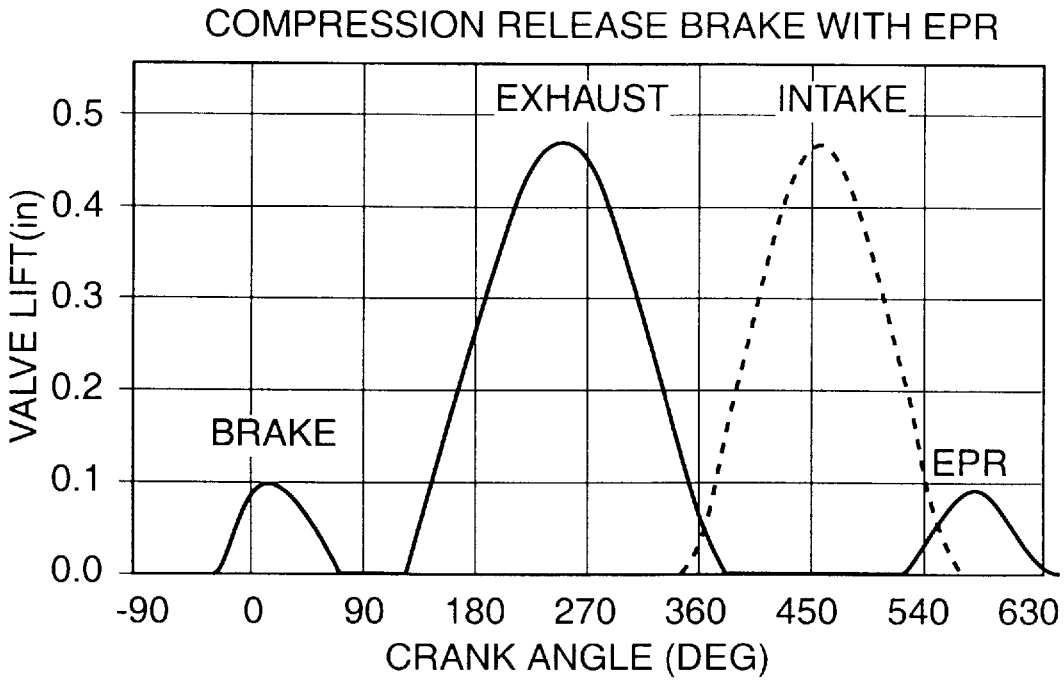
FIG. 11 is a graph of the exhaust and intake valve lift for a compression release brake with EPR.
Figure 12:
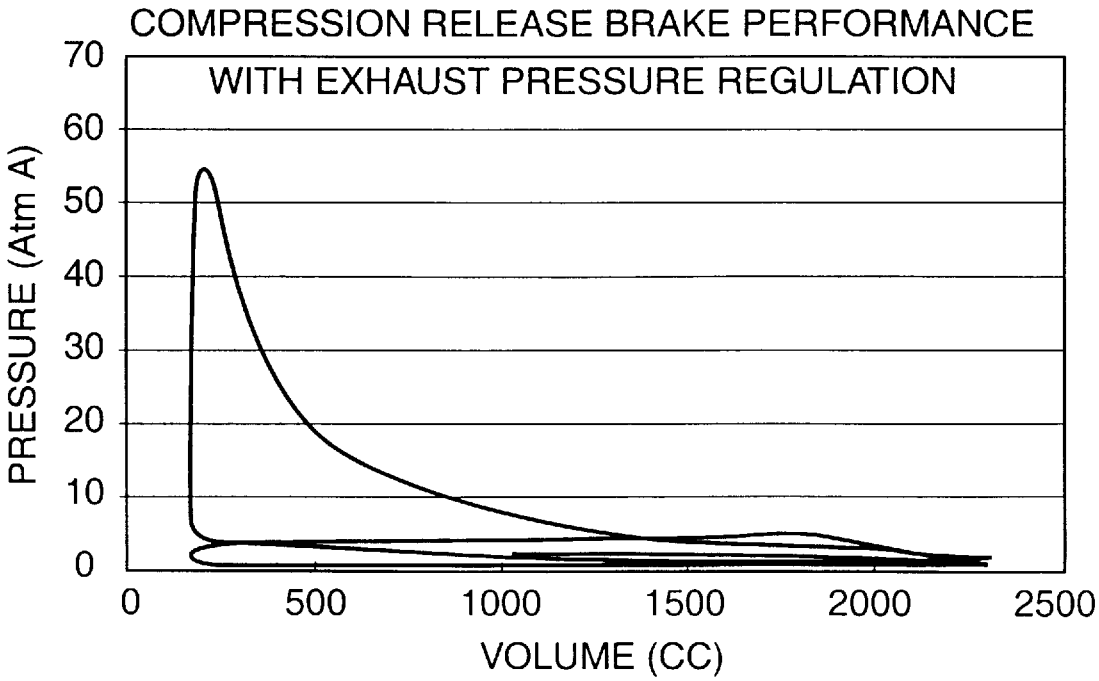
FIG. 12 is a graph of exhaust brake performance for the compression release brake with EPR shown in FIG. 11.

FIG. 11 illustrates the valve lift associated with a combination compression release brake and EPR system. Compression release in combination with EPR depends only on exhaust pressure. The exhaust pressure is maintained at a high level at low engine speed with a suitable exhaust restriction and is regulated with the EPR control strategy to comply with system load limits as engine speed increases. The contributions by compression release and exhaust brake effort combine (FIG. 12) to exceed the retarding power achieved in FIG. 10. The difference widens as engine speed goes down.

Application to Positive Power—Exhaust gas recirculation in internal combustion engines is desirable at certain engine speeds and loads to aid in $NO_x$ emission control. The system described in this disclosure is also applicable for this use. Since the EPR event is wholly controllable, i.e., it can be turned on and off or varied as required, the system can be used to benefit both the retarding and powering operation of the engine.

It will be apparent to one of ordinary skill in the art that various modifications and variations can be made to the system for operating the valve actuating subsystem 300, without departing from the scope or spirit of the invention. For example, the EGR may be provided by means of a main exhaust valve or an auxiliary valve furnished for this purpose. It will also be apparent to persons of ordinary skill in the art that various modifications and variations could be made in the control of the opening, closing, and magnitude of the exhaust gas recirculation valve opening event, without departing from the scope or spirit of the invention. Thus, it is intended that the present invention cover the variations and modifications of the invention, provided they come within the scope of the appended claims and their equivalents.

What is claimed is:

1. A method of controlling an exhaust gas parameter in an internal combustion engine having a piston which reciprocates to provide intake, compression, combustion, and exhaust strokes, said method using an exhaust gas recirculation event and an intake valve event, and comprising the steps of:

generating exhaust gas back pressure in the engine;

monitoring an exhaust gas parameter level; and carrying out an exhaust gas recirculation event responsive to the level of the parameter, wherein the exhaust gas parameter is controlled by selectively varying an overlap period between the exhaust gas recirculation event and the intake valve event.

2. The method of claim 1 wherein the parameter comprises engine manifold pressure.

3. The method of claim 1 wherein the parameter comprises engine manifold pressure.

4. The method of claim 1 wherein the parameter comprises engine cylinder pressure.

5. The method of claim 1 wherein the parameter comprises engine cylinder temperature.

6. The method of claim 1 further comprising the step of:

selectively controlling the duration of the exhaust gas recirculation event to control the mass charge in the cylinder.

7. The method of claim 6 wherein the exhaust gas recirculation event lasts until after the piston has completed a substantial portion of its compression stroke.

8. The method of claim 1 wherein the exhaust gas recirculation event lasts until after the piston has completed a substantial portion of its compression stroke.

9. The method of claim 1 further comprising the step of:

selectively controlling the lift of an exhaust valve opened for the exhaust gas recirculation event to control the mass charge in the cylinder.

10. The method of claim 1 wherein an exhaust valve opened for the exhaust gas recirculation event is opened prior to the end of the intake stroke and is closed after the piston has completed a substantial portion of the compression stroke.

11. A system for controlling the level of an exhaust gas parameter in an internal combustion engine by varying the overlap between an exhaust gas recirculation event and an intake valve event, comprising:

means for monitoring the level of an exhaust gas parameter; and means for selectively opening an exhaust valve to carry out an exhaust gas recirculation event in the engine in response to the exhaust gas parameter attaining a predetermined level, wherein the exhaust valve is opened at such a time as to provide an overlap between the exhaust gas recirculation event and an intake valve event that will prevent the parameter from substantially exceeding the predetermined level.

12. The system of claim 11 wherein the parameter comprises a pressure.

13. The system of claim 12 wherein the pressure occurs in an exhaust manifold.

14. The system of claim 12 wherein the pressure occurs in a cylinder of said engine.

15. The system of claim 11 wherein the parameter comprises a temperature.

16. The system of claim 15 wherein the temperature occurs in an exhaust manifold of said engine.

17. The system of claim 15 wherein the temperature occurs in a cylinder of said engine.

18. A method of optimizing engine performance of an internal combustion engine having a piston which reciprocates to provide intake, compression, combustion, and exhaust strokes, and in which overlapping exhaust gas recirculation and intake valve events are carried out, said method comprising the steps of:

increasing the overlap of the exhaust gas recirculation and intake valve events when the engine is placed in a positive power producing mode; and decreasing the overlap of the exhaust gas recirculation and intake valve events when the engine is placed in an engine braking mode.

19. The method of claim 18 wherein the step of increasing the overlap comprises carrying out the entire exhaust gas recirculation event during some portion of the intake valve event.

20. The method of claim 18 further comprising the step of: carrying out the exhaust gas recirculation event until after substantial portion of the compression stroke is completed.

21. A method of providing NOx control in an internal combustion engine during positive power comprising the step of selectively turning on and off the EGR event responsive to positive power and non-positive power modes of engine operation.

22. The method of claim 21 wherein the EGR event occurs entirely within the main exhaust event.

23. The method of claim 21 wherein EGR is regulated by selectively varying the opening and closing points and the magnitude of exhaust valve opening.

* * * * *

UNITED STATES PATENT AND TRADEMARK OFFICE

CERTIFICATE OF CORRECTION

PATENT NO. : 6,170,474 B1
DATED : January 9, 2001
INVENTOR(S) : Mark Israel

It is certified that error appears in the above-identified patent and that said Letters Patent is hereby corrected as shown below:

Column 10,
Line 15, delete “pressure” and insert -- temperature --.

Signed and Sealed this

Eighth Day of June, 2004

JON W. DUDAS
*Acting Director of the United States Patent and Trademark Office*